US006623113B2

(12) United States Patent
Yamada et al.

(10) Patent No.: US 6,623,113 B2
(45) Date of Patent: Sep. 23, 2003

(54) INKJET RECORDING HEAD INCLUDING ELECTRODE ASSEMBLY FOR DEFLECTING INK DROPLETS

(75) Inventors: Takahiro Yamada, Hitachinaka (JP); Hitoshi Kida, Hitachinaka (JP); Kunio Satou, Hitachinaka (JP); Shinya Kobayashi, Hitachinaka (JP); Naoto Ueda, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/285,528

(22) Filed: Nov. 1, 2002

(65) Prior Publication Data

US 2003/0085965 A1 May 8, 2003

(30) Foreign Application Priority Data

Nov. 2, 2001 (JP) ..... P2001-337775

(51) Int. Cl.[7] ..... B41J 2/09
(52) U.S. Cl. ..... 347/77
(58) Field of Search ..... 347/21, 74, 75, 347/76, 77, 78, 90

(56) References Cited

U.S. PATENT DOCUMENTS 4,122,458 A * 10/1978 Paranjpe ..... 347/77
4,292,640 A * 9/1981 Lammers et al. ..... 347/21
4,417,256 A * 11/1983 Fillmore et al. ..... 347/78
4,514,735 A * 4/1985 Jones ..... 347/76
4,544,930 A * 10/1985 Paranjpe ..... 347/77
4,734,705 A * 3/1988 Rezanka et al. ..... 347/75
5,473,353 A * 12/1995 Soucemarianadin et al. .. 347/74

FOREIGN PATENT DOCUMENTS

JP 2001-47622 2/2001

OTHER PUBLICATIONS

IBM, Brady et al., Sep. 1975.*

* cited by examiner

*Primary Examiner*—Anh T.N. Vo
(74) *Attorney, Agent, or Firm*—Whitham, Curtis & Christofferson, PC

(57) ABSTRACT

An electrode plate includes a base electrode plate, an edge forming electrode plate on the base electrode plate, and an ink reception absorption bodies embedded into the edge forming electrode plate. A plurality of head modules are precisely attached to the electrode plate so that nozzle rows formed in nozzle plates of the head modules extend following corresponding windows formed in the electrode plate. Such a precise attachment is realized by matching the pinholes formed in the nozzle plates to the corresponding pinholes formed in the base electrode plate and the edge-forming electrode plate.

14 Claims, 6 Drawing Sheets

11
13
12
IV
IV
13'

24
240
241
242

25
2523
2522
2523'
IV
IV
24
11
242
251
241

26
2623
28
2622
2623'
IV
IV

27
IV
IV

INKJET RECORDING HEAD INCLUDING ELECTRODE ASSEMBLY FOR DEFLECTING INK DROPLETS

BACKGROUND OF THE INVENTION

1. Field of the Invention

The present invention relates to an inkjet recording device, and more specifically to a high-speed inkjet recording device that reliably prints high quality images 2. Related Art Line-scan inkjet printers are a type of high-speed inkjet printer capable of printing on a continuous recording sheet at high speeds, and include an elongated inkjet recording head formed with rows of nozzles for ejecting ink droplets. The head is arranged in confrontation with the surface of the recording sheet across the entire width of the recording sheet. The head selectively ejects ink droplets from the nozzles based on a recording signal and impinges the droplets on desired positions across the width of the recording sheet. At the same time, the recording sheet is transported rapidly in its lengthwise direction, which serves as a main scanning operation so that images can be recorded at any place on the recording sheet.

Various types of line-scan inkjet printers have been proposed, such as printers that use a continuous inkjet type recording head and printers that use a dot-on-demand type recording head. Although dot-on-demand type line-scan inkjet printers have a slower printing speed than do continuous inkjet type line-scan inkjet printers, they have an extremely simple ink system and so are well suited for a general-purpose high-speed printer.

The recording head used in dot-on-demand type line-scan inkjet printers includes rows of nozzles, ink chambers in fluid communication with the nozzles, and piezoelectric elements or thermal elements for each ink chamber. The piezoelectric elements or thermal elements are driven to apply pressure to the ink in the ink chambers. The increase in pressure ejects an ink droplet from the corresponding nozzle in one dot-on-demand type line-scan inkjet printer, charging/deflecting electrodes are provided following the row of nozzles for deflecting ink droplets so that ink droplets ejected from adjacent nozzles impinge on the same pixel position. Because the impinging target of adjacent nozzles can be overlapped in this way, a complete image without missing information will be recorded even if some nozzles become defective and so cannot properly eject ink. This increases reliability of the printer and improves consistency in recording.

Japanese Patent Application No. 2001-47622 discloses a method for improving the yield of line-type recording head that includes charging/deflecting electrodes. In this method, short recording head modules with deflecting electrodes to the side of the nozzles are aligned end to end on a mounter to a length that matches the width of the recording sheet However, this conventional configuration requires a large number of charging/deflecting electrodes and a mounter, so that a great number of components need to be provided. Also, the components need to be assembled with the electrodes positioned precisely with respect to the nozzles. Further, the recording head needs to be positioned precisely on the mounter. Overall, the production costs of the head are high.

Further, because the electrodes located near nozzles protrude slightly from a nozzle surface in which the nozzles is are formed, a proper seal cannot be achieved around the nozzle holes by, for example, a capping mechanism or an ink purge mechanism provided for preventing the nozzles from being clogged.

Moreover, when the recording sheet lifts up toward the recording head or jams, the recoding sheet can scrape across and damage the nozzle surface.

SUMMARY OF THE INVENTION

In view of forgoing, it is an object of the present invention to overcome the above problems and also to provide an inkjet recording device with charging/deflecting electrodes that can be manufactured with low costs.

In order to achieve that above and other objects, the present invention provides a recording head including a plurality of head modules each formed with a plurality of nozzles, and an electrode assembly including assembled charging/deflecting electrodes for the plurality of head modules. The plurality of recording modules are attached to the electrode assembly. The electrode assembly serves as a mounting member for mounting all of the plurality of head modules thereon.

There is also provided an inkjet recording device including a recording head and a capping means. The recording head includes a plurality of head modules each formed with a plurality of nozzles, and an electrode assembly including assembled charging/deflecting electrodes for the plurality of head modules. The plurality of recording modules are attached to the electrode assembly. The electrode assembly serves as a mounting member for mounting all of the plurality of head modules thereon, and includes a conductive electrode plate formed with windows corresponding to the plurality of head modules. The head module includes a corresponding nozzle plate formed with the plurality of nozzles defining a nozzle row. The conductive electrode plate is in intimate contact with the nozzle plate. The nozzle row extends following one edge of the corresponding window. The capping means is in intimate contact with a side of the electrode plate that is opposite from a side of the electrode plate to which the nozzle plate is attached so as to block off the windows.

There is further provided an inkjet recording device including a recording head and purging means. The recording head includes a plurality of head modules each formed with a plurality of nozzles, and an electrode assembly including assembled charging/deflecting electrodes for the plurality of head modules. The plurality of recording modules are attached to the electrode assembly. The electrode assembly serves as an amounting member for mounting all of the plurality or head modules thereon, and includes a conductive electrode plate formed with windows corresponding to the plurality of head modules. The head module includes a corresponding nozzle plate formed with the plurality of nozzles defining a nozzle row. The conductive electrode plate is in intimate contact with the nozzle plate. The nozzle row extends following one edge of the corresponding window. The purging means is in intimate contact with a side of the electrode plate that is opposite from a side of the electrode plate to which the nozzle plate is attached so as to block off the windows.

Moreover, there is also provided with a recording head including a plurality of head modules each formed with a plurality of nozzles for selectively ejecting an ink droplet and a mounting means for mounting the plurality of head modules. The mounting means is formed with a plurality of windows for the plurality of head modules. Portions of the mounting means defining edges of the windows serve as charging/deflecting electrodes for deflecting the elected ink droplet.

BRIEF DESCRIPTION OF THE DRAWINGS

In the drawings:

FIG. 3(*b*) is a plan view of a frame of nozzle electrode array/mounter of the recording head;

FIG. 3(*c*) is a plan view of a base electrode plate of the nozzle electrode array/mounter;

FIG. 3(*d*) is a plan view of an edge-forming electrode plate of the nozzle electrode array/mounter;

FIG. 3(*e*) is a plan view of ink reception absorption bodies of the nozzle electrode array/mounter;

FIG. 7(*b*) is a plan view of the frame according to the modification;

FIG. 7(*c*) is a plan view of the base electrode plate according to the modification;

FIG. 8(*b*) is a plan view of the frame according to the another modification;

FIG. 8(*c*) is a plan view of the edge-forming electrode plate according to the another modification; and FIG. 8(*d*) is a plan view of the base electrode plate according to the another modification

PREFERRED EMBODIMENT OF THE PRESENT INVENTION

Next, an inkjet recording device including a recording head according to an embodiment of the present invention will be described with reference to the attached drawings.

Figure 1:
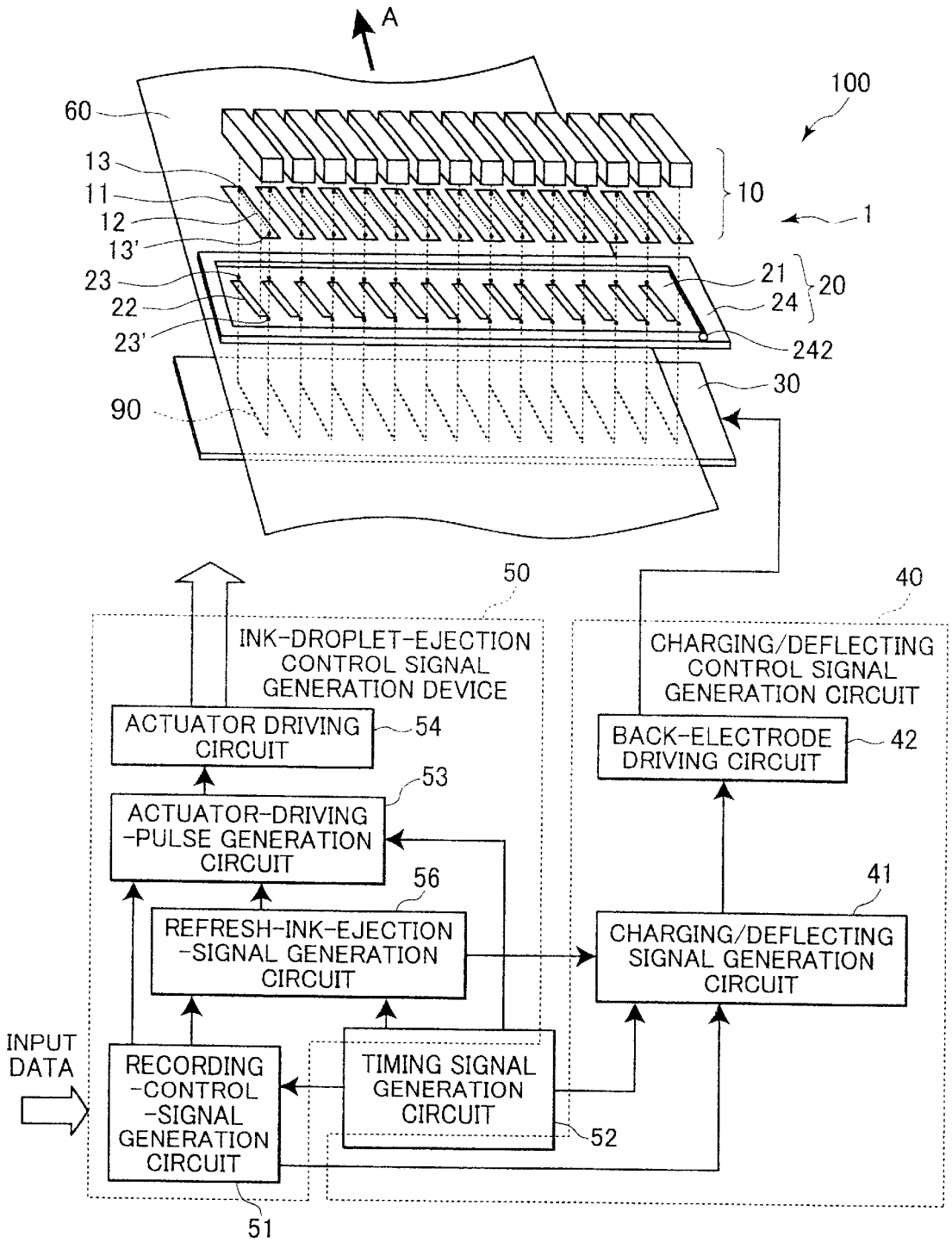
FIG. 1 is schematic view showing a drop-on-demand type inkjet printer with a line type recording head according to an embodiment or the present invention.

As shown in FIG. 1, an inkjet recording device 100 includes a recording head 1, a back electrode 30, a charging/deflecting control signal generation circuit 40, and an ink-droplet ejection signal generation circuit 50. Although not shown in the drawings, a unit is provided for feeding the recording sheet 60 in a direction indicated by an arrow A.

The recording head 1 includes a plurality of head modules 10 and a nozzle electrode array/mounter 20. Each head module 10 has a corresponding nozzle plate 11 formed of a conductive material, such as metal, with a plurality of nozzles 12 aligned equidistance from one another and a pair of pinholes 13, 13'. The nozzle plates 11 are attached intimately to the nozzle electrode array/mounter 20 at predetermined positions and orientations.

The nozzle electrode array/mounter 20 is an electrode assembly formed from arrayed charging/deflecting electrodes formed integrally with each other. The charging/deflecting electrodes are in one-to-one correspondence with the head modules 10. The nozzle electrode array/mounter 20 functions as a mounter, as a nozzle electrode for generating an angled electric field, and as an ink collection member for collecting refresh ink (described later).

The back electrode 30 is disposed in confrontation with the nozzle electrode array/mounter 20 on the opposite side of the recording shoot 60 than the nozzle electrode array/mounter 20. The charging/deflecting control signal generation circuit 40 is for generating and supplying charging/deflecting signals to the back electrode 30. The ink-droplet ejection signal generation circuit 50 is for generating and supplying ejection signals to the recording head 1.

The charging/deflecting control signal generation circuit 40 includes a charging/deflecting signal generation circuit 41 and a back-electrode driving circuit 42. The ink-droplet-ejection control signal generation device 50 includes a recording-control-signal generation circuit 51, a timing signal generation circuit 52, an actuator-driving-pulse generating circuit 53, an actuator driving circuit 54, and a refresh-ink-ejection-signal generation circuit 56.

The timing signal generation circuit 52 generates a timing signal, and outputs the timing signal to the recording-control-signal generation circuit 51, the actuator-driving-pulse generating circuit 53, the refresh-ink-ejection-signal generation circuit 56, and the charging/deflecting signal generation circuit 41.

The recording-control-signal generation circuit 51 generates a recording control signal based an input data and the timing signal, and outputs the same to the actuator-driving-pulse generating circuit 53, the refresh-ink-ejection-signal generation circuit 56, and the charging/deflecting signal generation circuit 41 The refresh-ink-ejection-signal generation circuit 56 generates a refresh-ink-ejection actuator driving signal based on the recording control signal, and outputs the same to the actuator-driving-pulse generating circuit 53 and the charging/deflecting signal generation circuit 41. The actuator-driving-pulse generating circuit 53 generates a recording pulse signal based on the recording control signal and also generates a refresh-ink-ejection pulse signal based on the refresh ink-ejection-actuator driving signal. The recording pulse signal and the refresh-ink-ejection pulse signal are both ink droplet ejection control signal for driving an actuator 70 (FIG. 4) of the head module 10 to be described later. The actuator driving circuit 54 amplifies the recording pulse signal and the refresh-ink ejection pulse signal to suitable level for driving the actuator 70.

The charging/deflecting signal generation circuit 41 generates a predetermined charging/deflecting signal (voltage) based on the timing signal from the timing signal generation circuit 52 and on the recording control signal from the recording-control-signal generation circuit 51 or on the refresh-ink-ejection actuator driving signal from the refresh-ink-ejection-signal generation circuit 56, and outputs the same to the back-electrode driving circuit 42. The back-electrode driving circuit 42 amplifies the charging/deflecting signal to a predetermined voltage, and then outputs the same to the back electrode 30.

Figure 4:
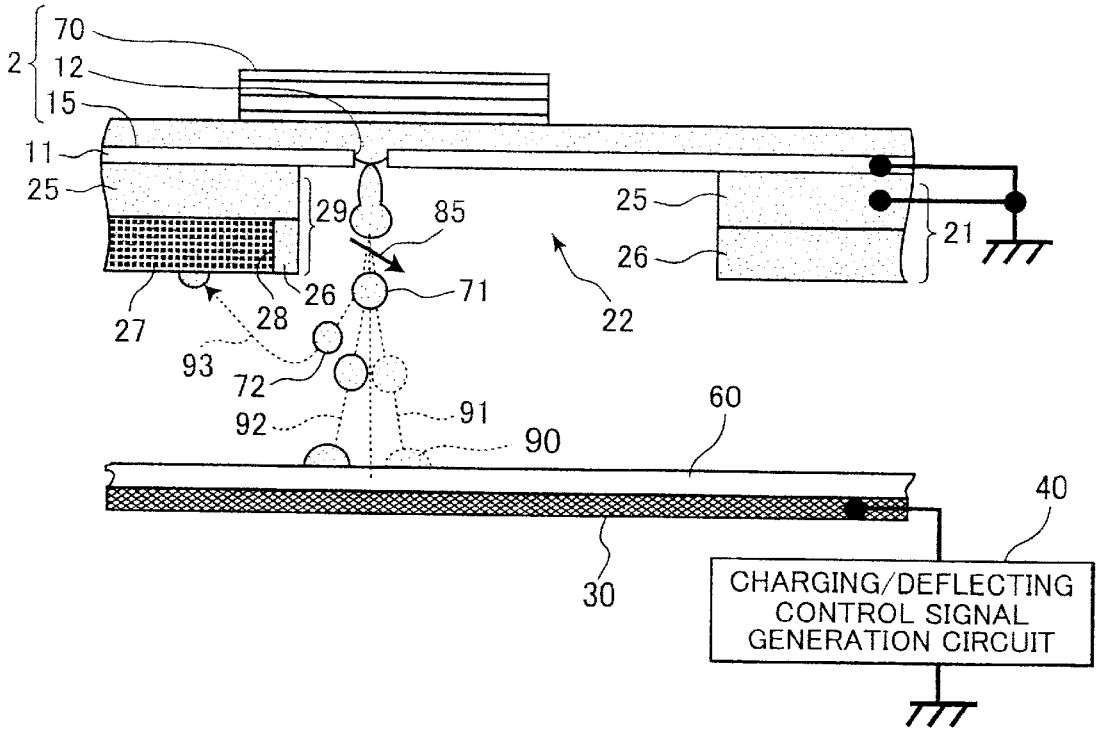
FIG. 4 is a cross-sectional view taken along a line IV—IV of FIGS. 3(*a*) to 3(*c*)

The head modules 10 are dot-on-demand type linear recording head modules formed with n-number of nozzle elements 2 Shown in FIG. 4. All of the nozzle elements 2 have the same configuration, and each has the nozzle 12 formed in the nozzle plate 11, a pressure chamber 15, and an actuator 70, such as a PZT piezoelectric element. The pressure chamber 15 is fluidly connected to the nozzle 12 and filled with ink. The actuator 70 is attached to the pressure chamber 15. When the actuator 70 is applied with a voltage, then the actuator 70 deforms, whereas when the actuator 70 is applied with no voltage, then the actuator 70 maintains its initial shape. Although not shown in the drawings, the head modules 10 is further formed with a manifold and ink inlet ports that introduce ink from the manifold to the corresponding pressure chambers 15.

With this configuration, when the ejection signal is applied to the actuator 70, then the actuator 70 deforms and thus changes the volume of the pressure chamber 15, whereby ejecting an ink droplet through the corresponding nozzle 12. The ink droplet will be a print ink droplet 71 or a refresh ink droplet 72 shown in FIG. 4 depending on the type of ejection signal.

Figures 3A, 3B, 3C, 3D, 3E:
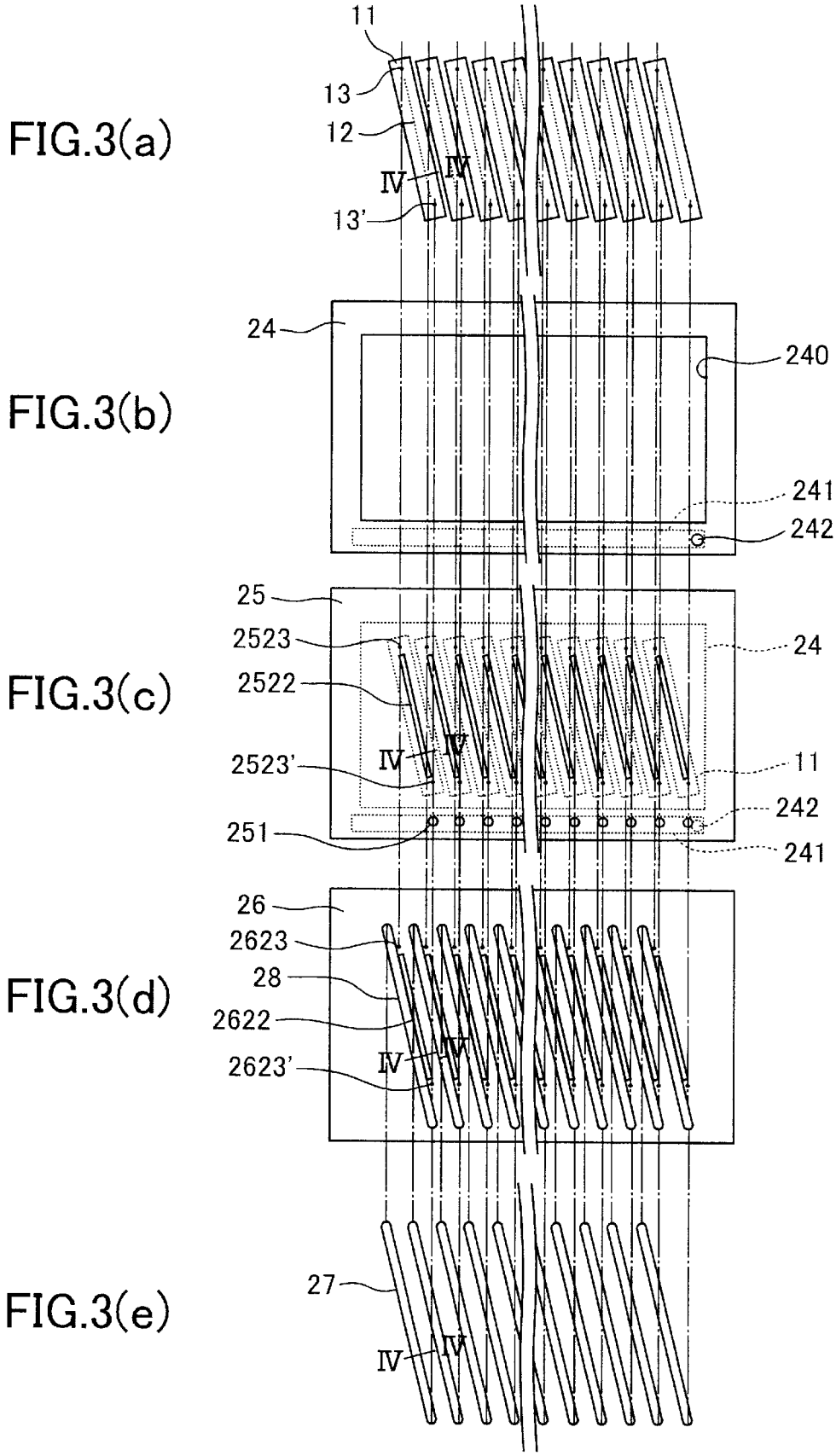
FIG. 3(*a*) is a plan view of nozzle plates of the head is modules.

Next, the nozzle electrode array/mounter 20 will be described. As shown in FIG. 1 the nozzle electrode array/mounter 20 includes an electrode plate 21 and a frame 24 to which the electrode plate 21 is adhered. As shown in FIG. 3(*b*), the frame 24 is formed with an opening 240 in the middle, a negative pressure pathway 241 in its lower surface, and a negative pressure collecting portion 242 in fluid connection with the negative pressure pathway 241.

The electrode plate 21 can be formed from stainless steel or other material that is resistant to corrosion by ink. As shown in FIG. 1, the electrode plate 21 is formed with a plurality of electrode windows 22 in one to one correspondence with the head modules 10 and also with pairs of pinholes 23, 23'. As shown in FIG. 4, one edge portion of the electrode windows 22 serves as charging/deflection electrode 29.

The electrode plate 21 includes a base electrode plate 25 shown in FIG. 3(*c*), an edge-forming electrode plate 26 shown in FIG. 3(*d*), and ink reception absorption bodies 27 shown in FIG. 3(*e*). The electrode plate 21 is formed by stacking the edge forming electrode plate 26 on the base electrode plate 25 and embedding the ink reception absorption bodies 27 into ink reception absorption body accommodation portions 28 of the edge forming electrode plate 26. The base electrode plate 25 and the edge forming electrode plate 26 can be mechanically fixed together in this stacked condition by adhesive, welding, or screws, for example. The base electrode plate 25, the edge forming electrode plate 26, and the ink reception absorption body 27 are each about 0.25 mm think, for example. In this case, the electrode plate 21 is about 0.5 mm thick.

The base electrode plate 25 shown in FIG. 3(*c*) is formed with a plurality of slits 2522, and pairs of pinholes 2523, 2523'. The base electrode plate 25 is also formed with a plurality of negative pressure connection holes 251 at positions corresponding to the negative pressure pathway 241, so that the negative pressure connection holes 251 are fluidly connected to the negative pressure pathway 241 when the base electrode plate 25 is attached to the frame 24.

The edge-forming electrode plate 26 shown in FIG. 3(*d*) is formed with a plurality of slits 2622 and the pairs of pinholes 2623, 2623'. The slits 2522 and corresponding slits 2622 together define the electrode windows 22 having a width of 2 mm. The pinholes 2523 and 2623 together define the pinholes 23, and the pinholes 2523' and 2623' together define pinholes 23'. The edge-forming electrode plate 26 is further formed with ink reception absorption body accommodation portions 28.

The accommodation portions 28 are fluidly connected to the connection hole 242 through the negative pressure connection holes 251 and the negative pressure pathway 241. The ink reception absorption bodies 27 can be formed from a porous stainless steel material or a filter material configured from stainless steel fibers.

Figure 2:
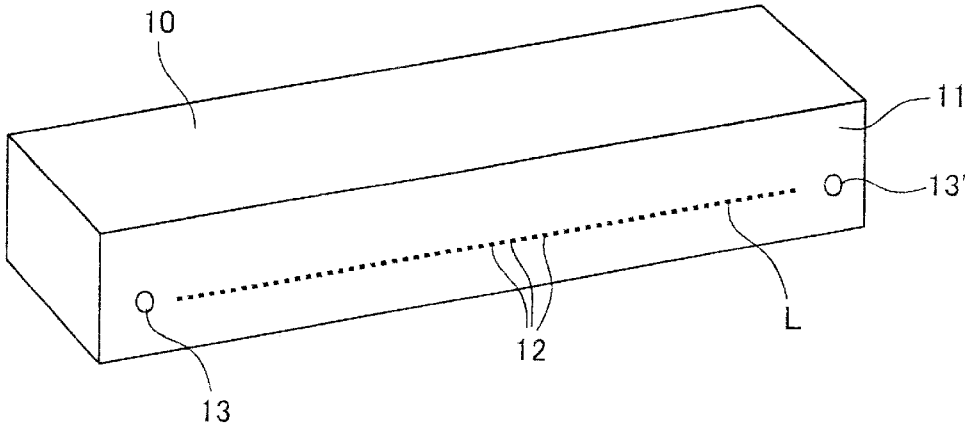
FIG. 2 is a perspective view showing one of head modules of the recording head of FIG. 1.

The electrode windows 22 formed in the electrode plate 21 are positioned following nozzle lines L in the head modules 10 shown in FIG. 2. As clearly shown in FIG. 4, the head modules 10 are attached to the electrode plate 21 such that the nozzle plate 11 of each head module 10 is in intimate contact with the electrode plate 21 and so that one side of the electrode window 22 is blocked off.

The edges of the electrode windows 22 are aligned following the nozzle lines L with a distance of 300 $\mu$m with a precision of ±10 $\mu$m or less. The positions of the nozzles 12 to the charging/deflecting electrodes 29 and the positions of the nozzles 12 of the different head modules 10 can simultaneously be regulated to a precision of ±10 $\mu$m or less. Such a precise positioning is realized by matching the pinholes 13, 13' formed in the nozzle plates 11 to the corresponding pinholes 2523, 2523', 2623, 2623' when positioning the nozzle plates 11, the base electrode plate 25, and the edge forming electrode plate 26 with respect to each other as shown in FIG. 3(*a*) through 3(*d*) Because the windows 22 are arranged precisely on the electrode plate 21, the nozzles 12 of the plurality of head modules 10 can be simultaneously positioned with high precision. As a result, the boundary between image portions recorded by adjacent recording head modules 10 is not noticeable.

The head modules 10 can be mechanically fixed to the electrode plate 21 by adhesive or screws, for example. When screws are used, nuts are fixed to the electrode plate 21 by adhesive or welding. Then, bolts are screwed through the head modules 10 and the electrode plate 21 at positions of the nuts to attach the head modules 10 to the electrode plate 21. Using screws to fix the head modules 10 to the electrode plate 21 has the advantage of enabling the head modules 10 to be easily replaced.

It should be noted that the nozzle plate 11, the base electrode plate 25, and the edge forming electrode plate 26 can be positioned using means other than pinholes. For example, the nozzle plate 11, the base electrode plate 25, and the edge forming electrode plate 26 can be formed with protrusions and indentations that fit together only when the relative positions of the nozzle plate 11, the base electrode plate 25, and the edge forming electrode plate 26 are correct to achieve the same effects as pinholes.

The edge forming electrode plate 26 can be formed with a highly precise edge even if ink reception absorption body 27 may not. Therefore, the charging/deflecting electrode 29 can be formed that includes the ink receiving absorbing body 27 precisely. Also, costs can be reduced because the line type recording head 1 has a simple configuration with few components and can be assembled with fewer steps.

As described above, portions 29 of the electrode plate 21 defining edges of the windows 22 serve as charging/deflection electrodes 29. The base electrode plate 25 (the charging/deflection electrode 29), the nozzle plate 11, and the ink filled in the nozzle elements 2 are all connected to the ground. Accordingly, when a voltage signal is applied to the back electrode 30, then an angled electrode 85 is generated between the nozzle plate 11 and charging/deflection electrode 29 and the back electrode 30.

Accordingly, the print ink droplet 71 is charged and deflected by the angled electric field 85. Thus deflected print ink droplet 71 flies along either a deflected flying trajectory 91 or a deflected flying trajectory 92, and then impinges on the recording sheet 60 to form a recording dot 90 thereon. On the other hand, although the refresh ink droplet 72 is charged and deflected by the angled electric field 85 in the similar manner, the deflected refresh ink droplet 72 flies along a U-turn trajectory 93, and then impinges on the ink reception absorption body 27 without reaching the recording sheet 60. The ink in the ink reception absorption body 27 is sucked through the negative pressure connection holes 251 and the negative pressure pathway 241 and collected through the negative pressure collecting portion 242 by negative pressure.

Figure 5:
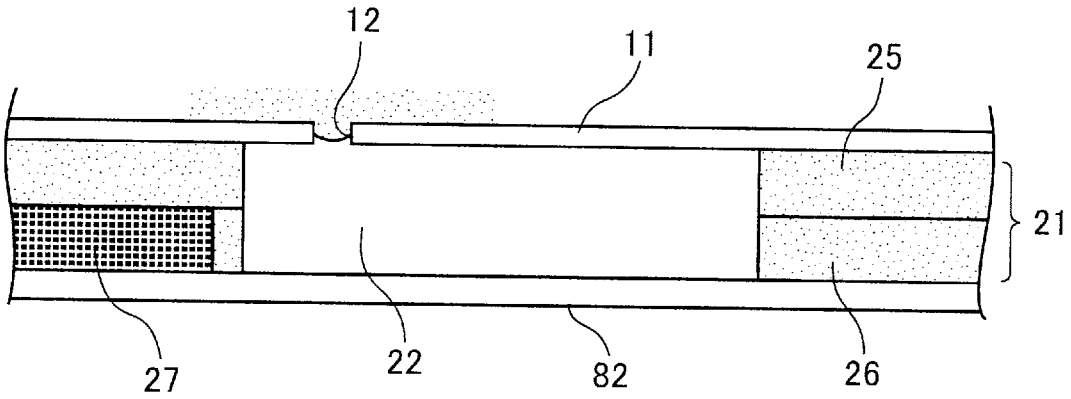
FIG. 5 is a cross-sectional view of the recording head with a nozzle cap placed thereover.

Although not shown in the drawings, the recording head 1 further includes a line-type capping unit and a purging unit. The capping unit includes a nozzle cap 82 Shown in FIG. 5, and the purging unit includes a purging cap 83 shown in FIG. 6.

The nozzle cap 82 is made of, for example, a silicon rubber sheet. The nozzle cap 82 is placed into intimate contact with the electrode plate 21 around the electrode windows 22, from the opposite side of the electrode plate 21 than the nozzle plate 11. In this manner, the nozzle cap 82 can render the nozzles 12 into a sealed condition using a simple configuration.

Figure 6:
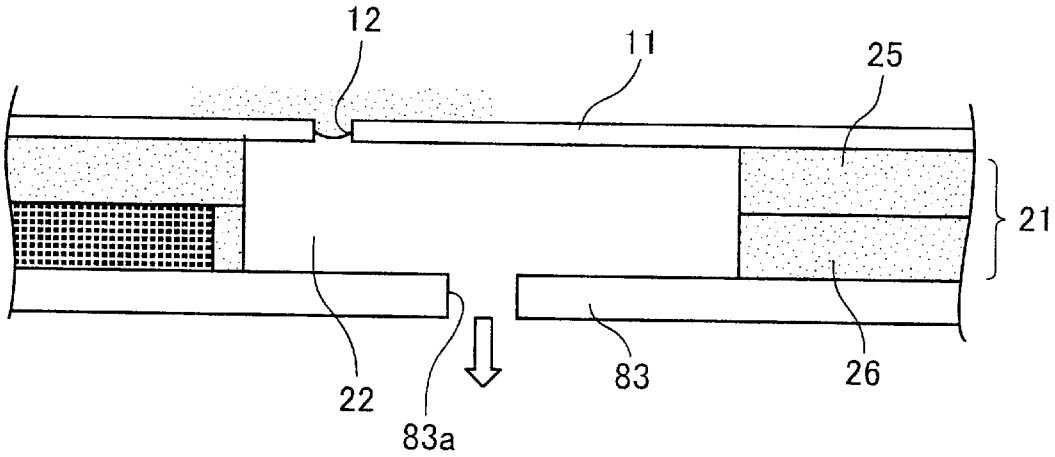
FIG. 6 is a cross-sectional view of the recording head with a purging cap placed thereover.

The purging cap 83 shown in FIG. 6 is made of a silicon rubber sheet with a suction port 83*a*. During the purging operation, the purging cap 83 is brought into intimate sealing contact with the edge-forming electrode plate 26 and the ink reception absorption body 27 to seal off the electrode windows 22. In this condition, ink is sucked through the nozzles 12 and collected in a well-known technique. In this manner, the purging operations are easily performed.

Even if the recording sheet 60 lifts up towards the line-type recording head 1 or jams near the nozzles 12 while the recording sheet 60 is being transported at a high speed, the frame 24 of the electrode plate 21 prevents the recording sheet 60 from scraping against the nozzles 12, so that the nozzles 12 are not inflicted with damage that shortens the life of the line-type recording head 1.

According to the present invention, nozzles 12 of the entire recording head 1 can be assembled with great precision by merely assembling such that the nozzles 12 and the electrodes 29 are arranged precisely. As a result, the configuration is simple and fewer components are required. The number of assembly stops and costs are reduced Because the configuration enables the electrode windows 22 to be sealed shut, a nozzle cap mechanism and purge mechanism can be easily realized. The frame 24 of the electrode plate 21 prevents the nozzles 12 from being scraped by the recording sheet 60. This provides a very reliable recording head.

While some exemplary embodiments of this invention have been described in detail, those skilled in the art will recognize that there are many possible modifications and variations which may be made in these exemplary embodiments while yet retaining many of the novel features and advantages of the invention.

For example, the embodiment described the electrode plate 21 as being configured by stacking the base electrode plate 25 on the edge forming electrode plate 26, which is embedded with the ink reception absorption bodies 27. However, any of these components can be removed as needed.

Figures 7A, 7B, 7C:
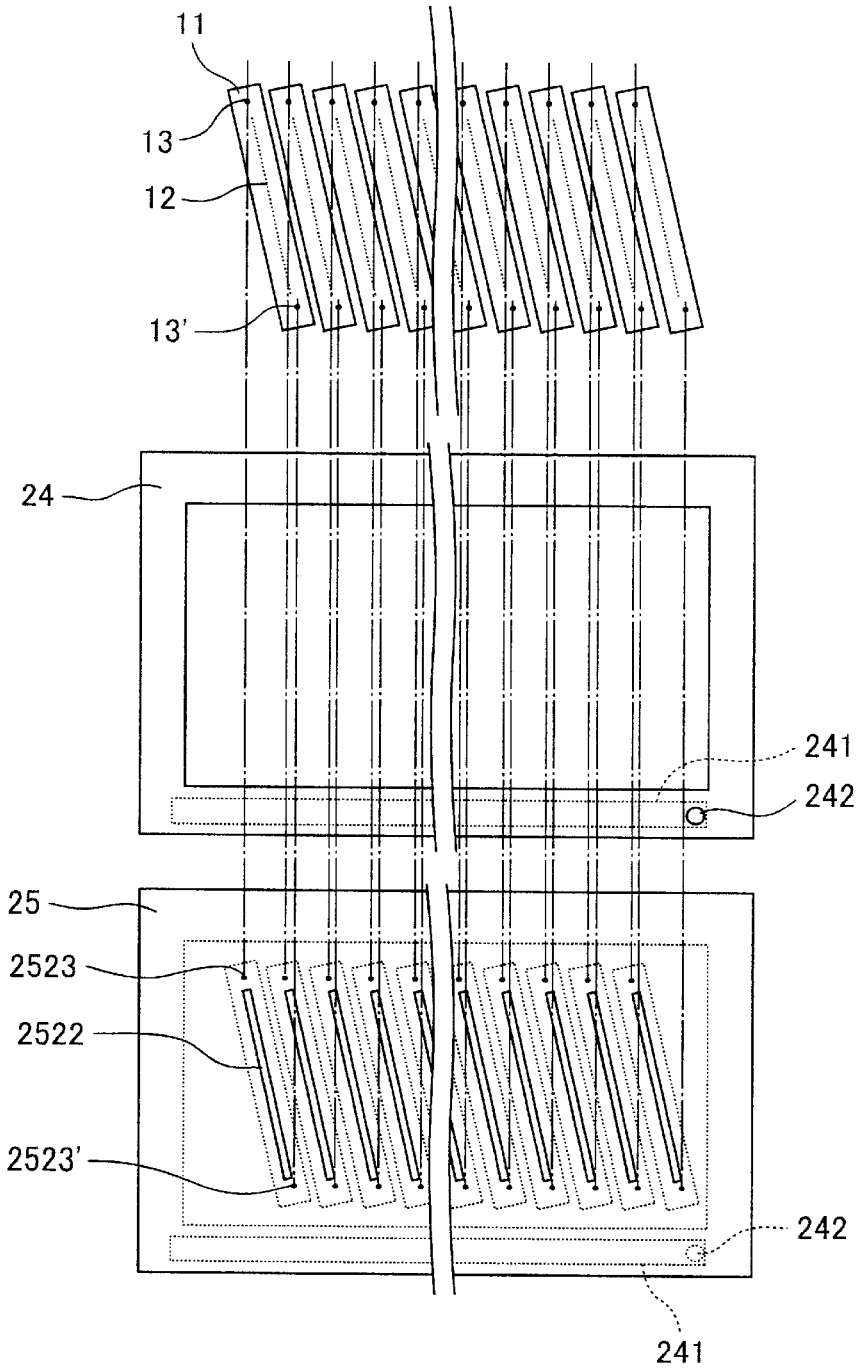
FIG. 7(*a*) is a plan view of nozzle plate according to a modification of the embodiment.
Figures 8A, 8B, 8C, 8D:
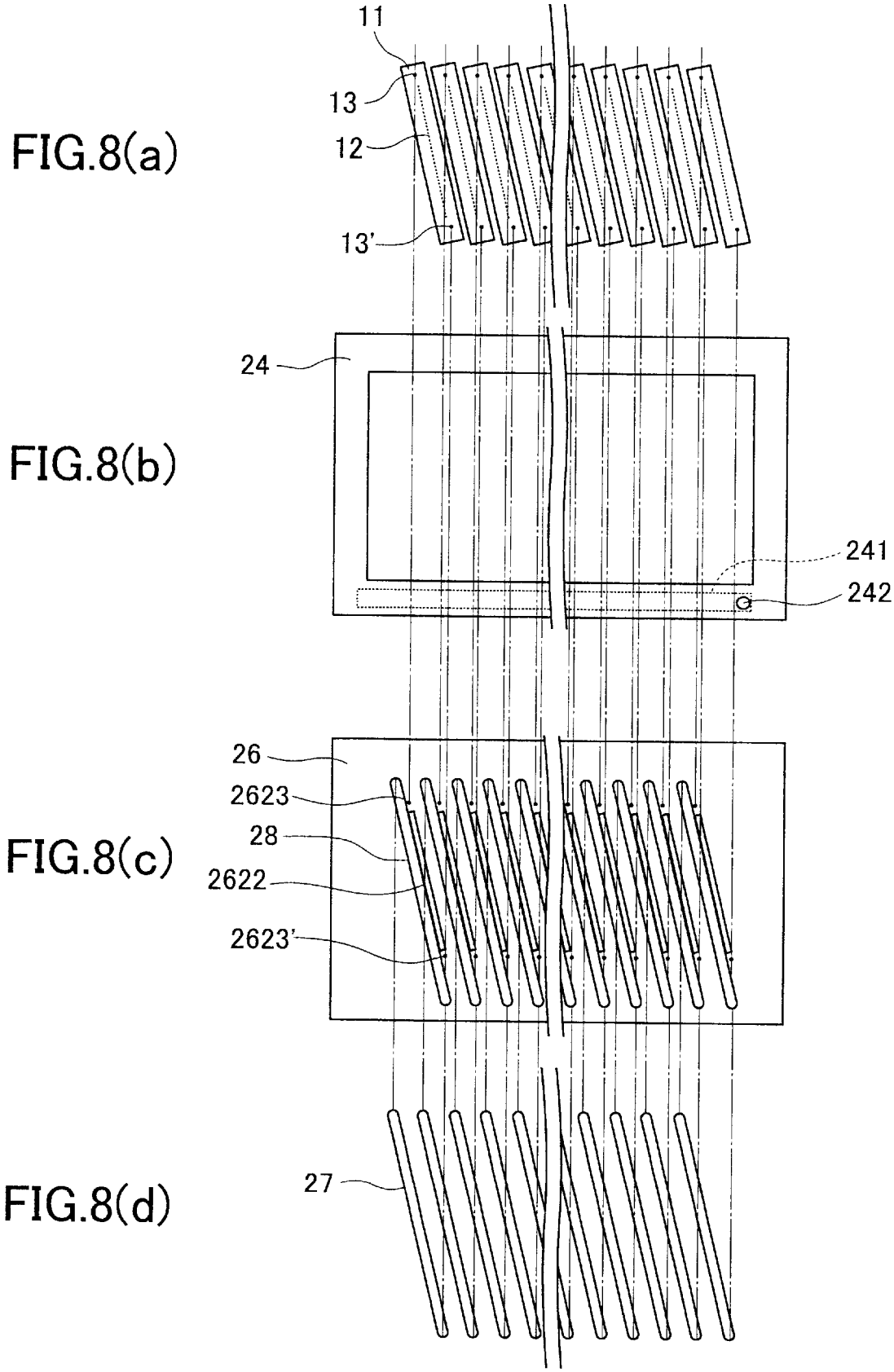
FIG. 8(*a*) is a plan view of nozzle plate according to another modification of the embodiment.

For example, if there is no need to discharge ink out of the base electrode plate 25 using the negative pressure or the like, then as shown in FIGS. 7(*a*) to 7(*c*) only the base electrode plate 25 need be provided to the electrode plate 21. Also, even when only the base electrode plate 25 is provided, the electrode plate 21 can be provided with a function for collecting refresh ink droplets by making the base electrode plate 25 from materials such as a porous stainless steel material or a filter material made from hardened stainless steel fiber. Alternatively, as shown in FIGS. 8(*a*) to 8(*e*), the base electrode plate 25 can be omitted and only the edge-forming electrode plate 26 can be provided with the ink reception absorption bodies 27 embedded therein. With these configurations, the number of is components and costs can be further reduced.

The nozzle electrode array/mounter 20 of the above embodiment is formed from arrayed electrodes 29 with the windows 22 with the same number and positioning as the mounted recording head modules 10. However, this is not a limitation of the invention. For example, arrayed electrode windows, ink absorption body accommodation portions, head module mounting portions, recording head module fixing screw portions, and the like can be machined into a metal block to produce a sturdy configuration by die cast. Also, the nozzle electrode array/mounter can be made from any material as long as the portion that follows the nozzle row is a conductive material. For example, electrode portion can be made from metal embedded into a plastic-based nozzle electrode array/mountor or can be an electrode portion formed using metal plating.

Although the embodiment described a flat nozzle electrode array/mounter, an arc-shaped nozzle electrode array/mounter that follows the curve of a drum can be used if the recording sheet is recorded on while wrapped around such a drum.

What is claimed is:

1. A recording head comprising:

a plurality of head modules, each formed with a plurality of nozzles; and an electrode assembly including assembled charging/deflecting electrodes for the plurality of head modules, the plurality of recording modules being attached to the electrode assembly, wherein the electrode assembly serves as a mounting member for mounting all of the plurality of head modules thereon.

2. The recording head according to claim 1, wherein the plurality of head modules selectively eject ink droplets from the nozzles, and the charging/deflecting electrodes selectively deflect the ejected ink droplets.

3. The recording head according to claim 1, further comprising a positioning means for regulating attachment positions of the plurality of head modules on the electrode assembly, the positioning means simultaneously regulating relationship of the positions of the nozzles relative to the charging/deflecting electrodes and also positions of the nozzles of one head module relative to the nozzles of other head modules.

4. The recording head according to claim 3, wherein the positioning means is a pinhole.

5. The recording head according to claim 1, wherein the electrode assembly includes a conductive electrode plate formed with windows corresponding to the plurality of head modules;

each head module includes a corresponding nozzle plate formed with the plurality of nozzles defining a nozzle row;

the conductive electrode plate is in intimate contact with the nozzle plate; and the nozzle row extends following one edge of the corresponding window.

6. The recording head according to claim 5, further comprising an ink absorbing body embedded into the electrode plate following the corresponding nozzle row.

7. The recording head according to claim 5, wherein the electrode plate is formed of an ink absorbing material.

8. The recording head according to claim 5, wherein the windows are sealed closed by the nozzle plate.

9. An inkjet recording device comprising:

a recording head including a plurality of head modules, each formed with a plurality of nozzles;

an electrode assembly including assembled charging/deflecting electrodes for the plurality of head modules, the plurality of head modules being attached to the electrode assembly, wherein the electrode assembly includes a conductive electrode plate formed with windows corresponding to the plurality of head modules, each head module including a corresponding nozzle plate formed with the plurality of nozzles defining a nozzle row, the conductive electrode plate being in intimate contact with the nozzle plate, and the nozzle row extending following one edge of the corresponding window;

the electrode assembly serving as a mounting member for mounting all of the plurality of head modules thereon; and a capping means in intimate contact with a side of the electrode plate that is opposite from a side of the electrode plate to which the nozzle plate is attached so as to block off the windows.

10. An inkjet recording device comprising:

a recording head including a plurality of head modules, each formed with a plurality of nozzles;

an electrode assembly including assembled charging/deflecting electrodes for the plurality of head modules, the plurality of head modules being attached to the electrode assembly, wherein the electrode assembly includes a conductive electrode plate formed with windows corresponding to the plurality of head modules, each head module including a corresponding nozzle plate formed with the plurality of nozzles defining a nozzle row, the conductive electrode plate being in intimate contact with the nozzle plate, and the nozzle row extending following one edge of the corresponding window;

the electrode assembly serving as a mounting member for mounting all of the plurality of head modules thereon; and a purging means in intimate contact with a side of the electrode plate that is opposite from a side of the electrode plate to which the nozzle plate is attached so as to block off the windows.

11. A recording head comprising:

a plurality of head modules, each formed with a plurality of nozzles for selectively ejecting ink droplets; and a mounting means for mounting all the plurality of head modules, the mounting means being formed with a plurality of windows for the plurality of head modules, wherein portions of the mounting means defining edges of the windows serve as charging/deflecting electrodes for deflecting the ink droplets ejected from the nozzles.

12. The recording head according to claim 11, wherein the plurality of nozzles formed in each head module define a corresponding nozzle row, and the head module is attached to the mounting means such that the nozzle row follows the edge of the corresponding window.

13. The recording head according to claim 12, wherein the mounting means includes a plate formed with the plurality of windows and a frame attached to the plate, and the head modules are attached to the plate.

14. The recording head according to claim 13, wherein the mounting means further includes a plurality of ink reception absorption bodies for collecting the ink droplets deflected by the charging/deflecting electrodes, the ink reception absorption bodies being embedded in the plate following the edges of the windows.

* * * * *